United States Patent [19]

Sardella

[11] 4,254,692

[45] Mar. 10, 1981

[54] HELICAL FOLDER FOR PAPERBOARD BLANKS

[75] Inventor: Louis M. Sardella, Towson, Md.

[73] Assignee: Wm. C. Staley Machinery Corporation, Hunt Valley, Md.

[21] Appl. No.: 137,104

[22] Filed: Apr. 4, 1980

[51] Int. Cl.[3] ..... B31B 1/42

[52] U.S. Cl. ..... 493/179

[58] Field of Search ..... 93/52, 49 R, 48, 84 TW, 93/82, 36 R

[56] References Cited

U.S. PATENT DOCUMENTS

| | | | |
|---|---|---|---|
| 549,571 | 11/1895 | Koffenberger | 93/52 X |
| 770,159 | 9/1904 | Burbank | 93/48 |
| 862,161 | 8/1907 | Hollett | 93/52 |
| 2,308,010 | 1/1943 | Horowitz | 93/52 X |
| 2,768,492 | | Kay et al. | 93/52 X |
| 3,791,268 | 2/1974 | Kollmar | 93/49 R X |
| 4,056,046 | 11/1977 | Hughes | 93/49 R |

OTHER PUBLICATIONS

Sunds AB, EMBA, "Flexo Folder Gluer 140", (date unknown).

*Primary Examiner*—James F. Coan

[57] ABSTRACT

Apparatus for folding paperboard blanks, fed one by one in timed sequence into said apparatus and transported through it, includes helical blank contacting means rotatable in time with the transport means about a longitudinal axis extending generally in the direction of travel.

8 Claims, 9 Drawing Figures

| | |
|---|---|
| FIG. 3A. | FIG. 3B. |

HELICAL FOLDER FOR PAPERBOARD BLANKS

TECHNICAL FIELD

This invention relates to apparatus for folding paperboard blanks (such as corrugated blanks or sheets).

Such apparatus is useful, for example, as one in a series of machines operating in timed relationship to convert paperboard blanks, one-by-one, into boxes. When used in such series of machines, such apparatus is typically referred to as a folder/gluer. The folder/gluer usually receives its feed from a creasing/slotting unit which receives its feed directly or indirectly from a feeding unit. Between the feeding unit and the creasing/slotting unit can be a rotary die-cutter and one or more printing units. After the folder/gluer there is usually a counter/ejector. The folder/gluer ordinarily receives a blank with four side-by-side panels separated from one another by longitudinal creases and slots and with a glue tab associated with one of the outboard panels. It applies glue to the glue tab and folds each outboard panel relative to the adjacent inboard panel along the intervening crease and discharges flattened tubes.

BACKGROUND ART

One type of apparatus used for folding paperboard blanks involves a stationary rail. The rail is configured and positioned so that, as a blank is conveyed through the apparatus, the rail bears on an outboard panel of the blank at its leading edge and causes that panel to swing relative to an adjacent panel along a crease between the panels. The apparatus operates acceptably during an initial portion of the folding. Such is not the case with the last portion of a 180 degree fold. During this last portion of folding, the resistance to folding greatly increases due to material interference in the crease. When this occurs, the force of the rail at the leading edge of the panel being folded, with more than acceptable frequency, causes a fold slanted from the direction of feed ("fish tailing") and/or the occurrence of folding at a cross-machine crease (corrugator score) leading to a jam up.

In an attempt to minimize the occurrence of "fish tailing", the apparatus described above has been modified to replace a last portion of the stationary rail with a twisted, high friction material, moving belt. Like the stationary rail, the moving belt folds by bearing on the leading edge of an outboard panel as the blank is conveyed. But, unlike the stationary rail, it pulls such panel in an attempt to match speeds with the conveyor to prevent the occurrence of "fish tailing". Such speed matching is difficult to obtain on a consistent basis. Thus, this modification does not entirely eliminate "fish tailing" and can even cause "fish tailing". Moreover, with this modification, folding at a cross-machine crease is still a problem.

Apparatus exist or are known which include means rotating in time with the machine and having axis of rotation perpendicular to the direction of travel. Such means bear on interior portion of a panel to cause rather abrupt folding (a large amount of folding during a relatively short distance of board travel). Such abrupt action can result in panel damage especially when corrugated blanks are being processed at high rates of travel. Such apparatus can also involve an impacting (i.e. slapping) action which can harm a blank.

BRIEF DESCRIPTION OF THE INVENTION

It is an object of this invention to provide apparatus for folding paperboard blanks whereby the chance of "fish tailing" is substantially eliminated independently of speed matching, whereby the chance of folding in a cross machine direction is substantially eliminated, and whereby folding is carried out smoothly (rather than abruptly) and without any impacting force being applied.

These objects and other objects and advantages are readily obtained by the invention herein as described below.

The apparatus herein is for folding paperboard blanks fed one by one in timed sequence into the apparatus. The blanks each comprise a first panel and a second panel separated by a crease (the intervening crease). The folding comprises folding the first panel with respect to the second panel along the intervening crease from an initial angular relationship between said panels denoted herein as an entrance angle (the angle included between said first and second panels as the blank enters the folding operation) to a resulting angular relationship between said panels denoted herein as an exit angle (the angle included between said first and second panels as the blank leaves the folding action).

The apparatus herein comprises conveyor means, elongated helical folding means adapted to be rotated, and means to rotate the elongated helical folding means. The conveyor means is adapted to transport the blanks one by one in a direction of travel with said second panel of each blank being moved along a plane of travel. The elongated helical folding means comprises elongated helical blank contacting means and shaft means which supports said helical blank contacting means. The helical blank contacting means has a longitudinal axis extending generally in the direction of travel. The shaft means extends coaxially with said longitudinal axis and is rotatable about said longitudinal axis to cause rotation of said helical blank contacting means about said axis. The shaft means has ends positioned to accommodate said entrance angle and provide said exit angle. The means to rotate the elongated helical folding means comprises means to rotate the shaft means whereby the helical blank contacting means is rotated about said longitudinal axis in fixed operating ratio with conveyor speed.

The configuration and positioning of the elongated helical folding means (the shape and extent of the helical blank contacting means and the positioning of the shaft means) and the fixed operating ratio are adapted to provide improved folding. This improved folding includes initial contact between the helical blank contacting means and the first panel without impact and only at an interior portion of said first panel. This improved folding also includes continuous contact between the helical blank contacting means and only interior portion of the first panel from the initial contact up to the completion of the folding. The improved folding involves smooth folding of the first panel toward the second panel.

Preferred apparatus includes stationary rail folding means upstream of the elongated helical folding means. The stationary rail folding means is adapted to operate on a blank with the aforedescribed first and second panels in the same plane and to fold the first panel causing it to swing through an angle defining a first portion of folding. The downstream elongated helical folding means is adapted to operate on the blank so treated by the stationary rail folding means to complete the folding (i.e., fold the first panel against the second panel).

The term "helical blank contacting means" is used herein to embrace members helical in a broad sense unless otherwise indicated. In other words, such means can be in the shape of a cylindrical helix or in the shape of a helix with a radius (distance to the longitudinal axis) which varies (such as a conical helix).

The term "interior portion" is used herein to mean a part of the surface of the panel removed from the edges and inboard of corrugator scores (cross machine direction creases).

The term "smooth" in the expression "smooth folding" is used herein to mean not abrupt and carried out over a relatively long distance of paperboard blank travel (e.g. a folding rate of not more than about 15 degrees per foot of travel in contact with a blank contacting, i.e., folding, member).

BRIEF DESCRIPTION OF THE DRAWINGS

FIG. 3 is made up of FIGS. 3A, 3B and 3C.

DETAILED DESCRIPTION

Figure 1:
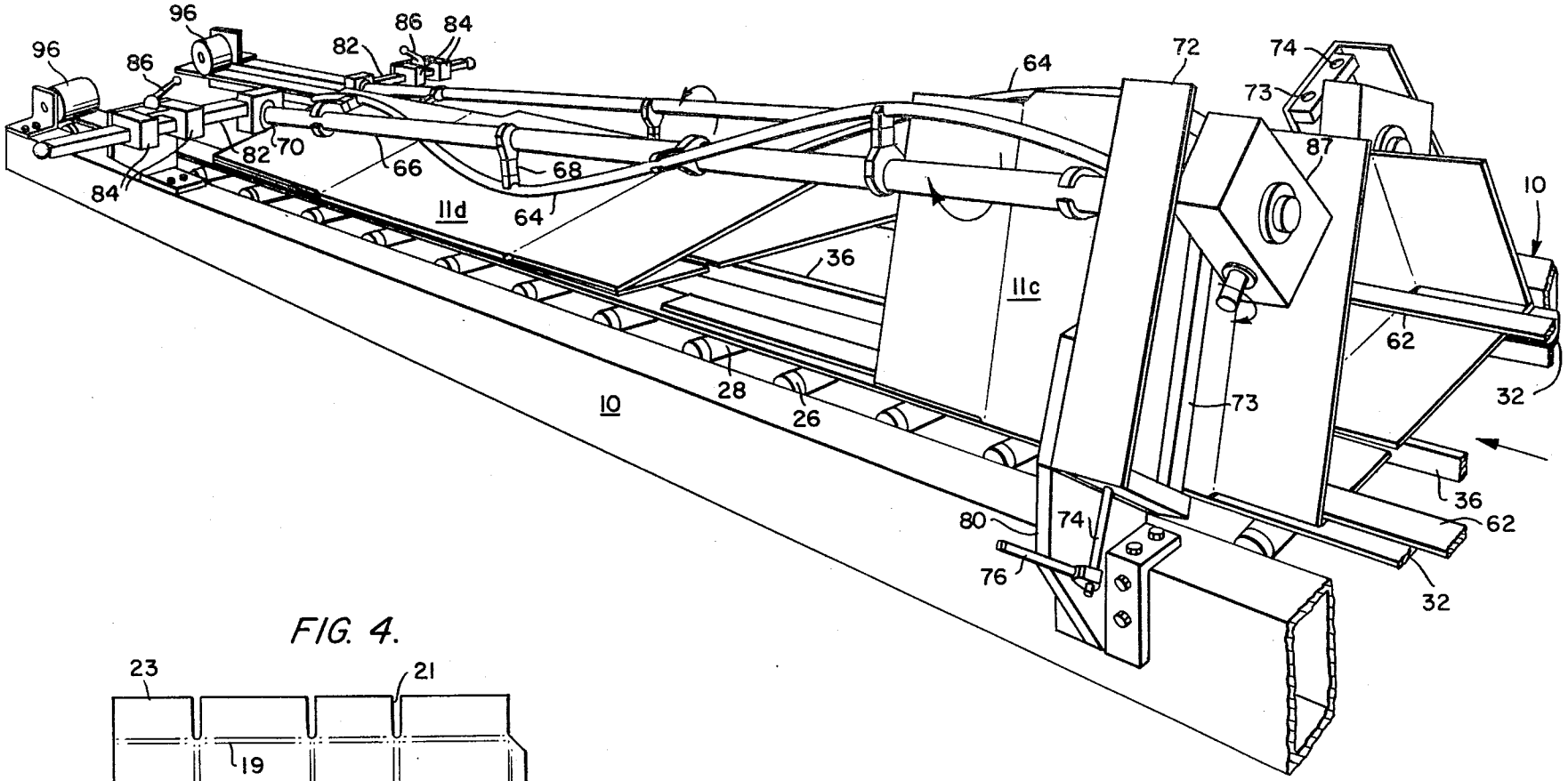
FIG. 1 is a perspective view of a downstream portion of apparatus within the scope of the invention and also depicts the elongated helical folding means carrying out a last portion of folding.
Figure 2:
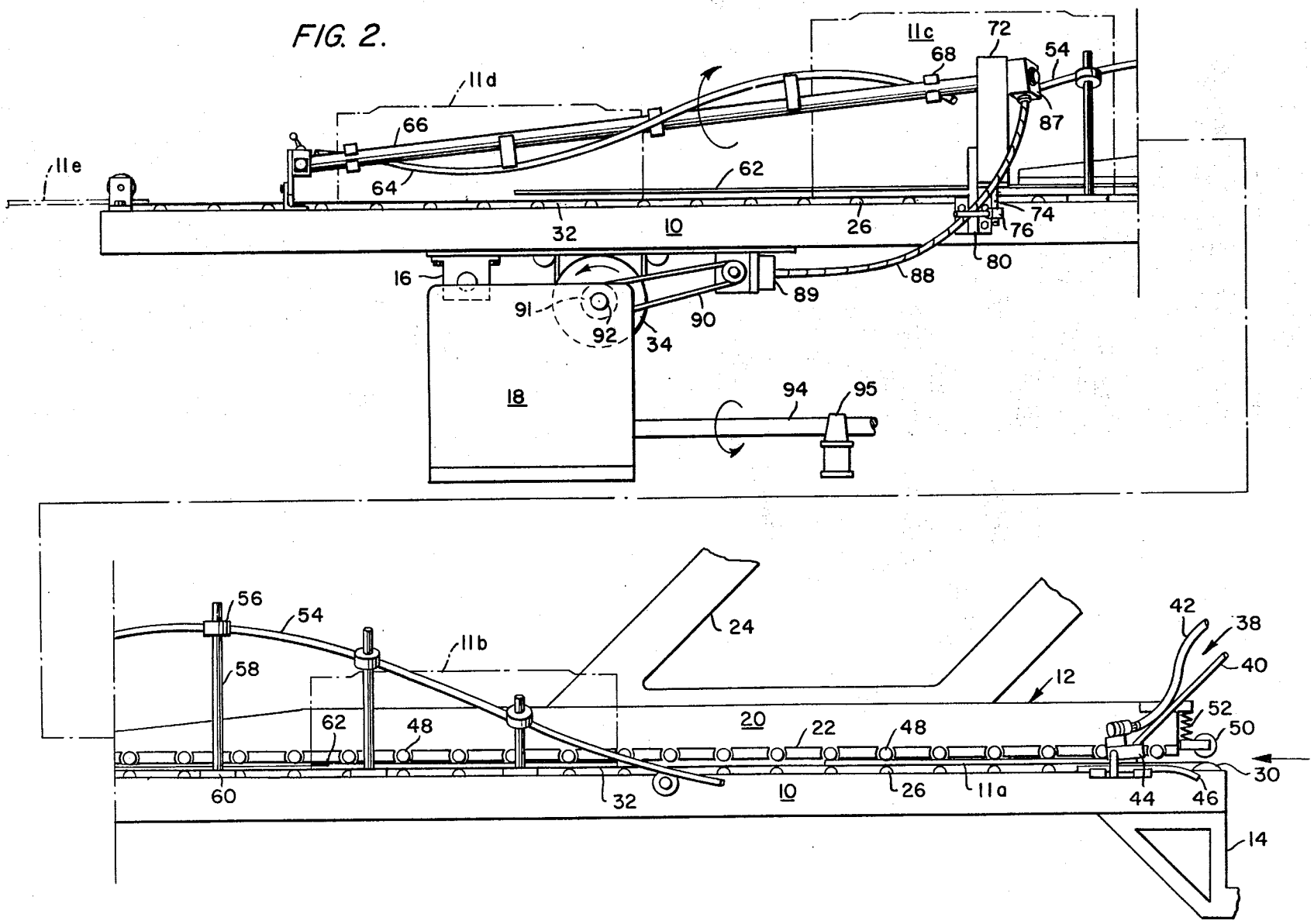
FIG. 2 is a side view of the whole of the apparatus partly depicted in FIG. 1 and also depicts the folding operation.

Continuing reference is made to FIGS. 1, 2 and 3 of the drawings.

The main structural elements of the apparatus depicted are lower side rails 10 and upper side rails 12.

The side rails 10 are tubular members which extend the length of the apparatus on each side. As seen in FIG. 2, the upstream end of each side rail 10 is supported on a bracket 14 which in turn is supported on means not shown. Also as seen in FIG. 2, the downstream portion of each side rail 10 is supported on a load bearing member 16. The members 16 are supported on a cross tie (not shown) which extends between and is supported by plates 18.

The side rails 12 have an L-shaped cross section except where portions are milled out to accommodate rollers described later. They extend on each side of apparatus from the inlet end terminating in a tapered portion just prior to the portion of the machine including the elongated helical folding means. Each rail 12 includes an upwardly extending leg 20 and also an outwardly extending roller accommodating portion 22. Each rail 12 is supported from above in cantilever fashion by means of an upper rail support 24 which in turn is supported by an upper structure (not shown).

Supported on the inboard side of each rail 10 are bearings 26 which are spaced along the length of the apparatus. Rotatably supported on each bearing 26 is a lower roller 28 (see FIG. 1) thereby providing on each side of the machine a set of lower rollers 28.

Trained on each set of lower rollers 28 and over a turn around roller 30 is a conveyor means in the form of a conveyor belt 32 which is driven by a pulley 34. Each of the belts 32 is narrow in width (e.g., 4 inches) and has a high coefficient of friction surface (e.g. polyurethane, rubber or the like) whereby to engage and grip a blank to move it through the apparatus.

Extending the length of the apparatus spaced between the two lower side rails 10 is a sheet support bar 36. Bar 36 is supported from the floor by means not depicted.

Included at the upstream end of the machine is a glue applicator 38. It includes upwardly and backwardly extending member 40 which is supported from an upper structure which is not depicted. It also includes glue supply hose 42 and nozzle 44 and an electric eye mechanism (not depicted) for signaling nozzle 44 to operate. Curved bar 46 is provided to support the underside of the blank as glue is applied.

Figure 3A:
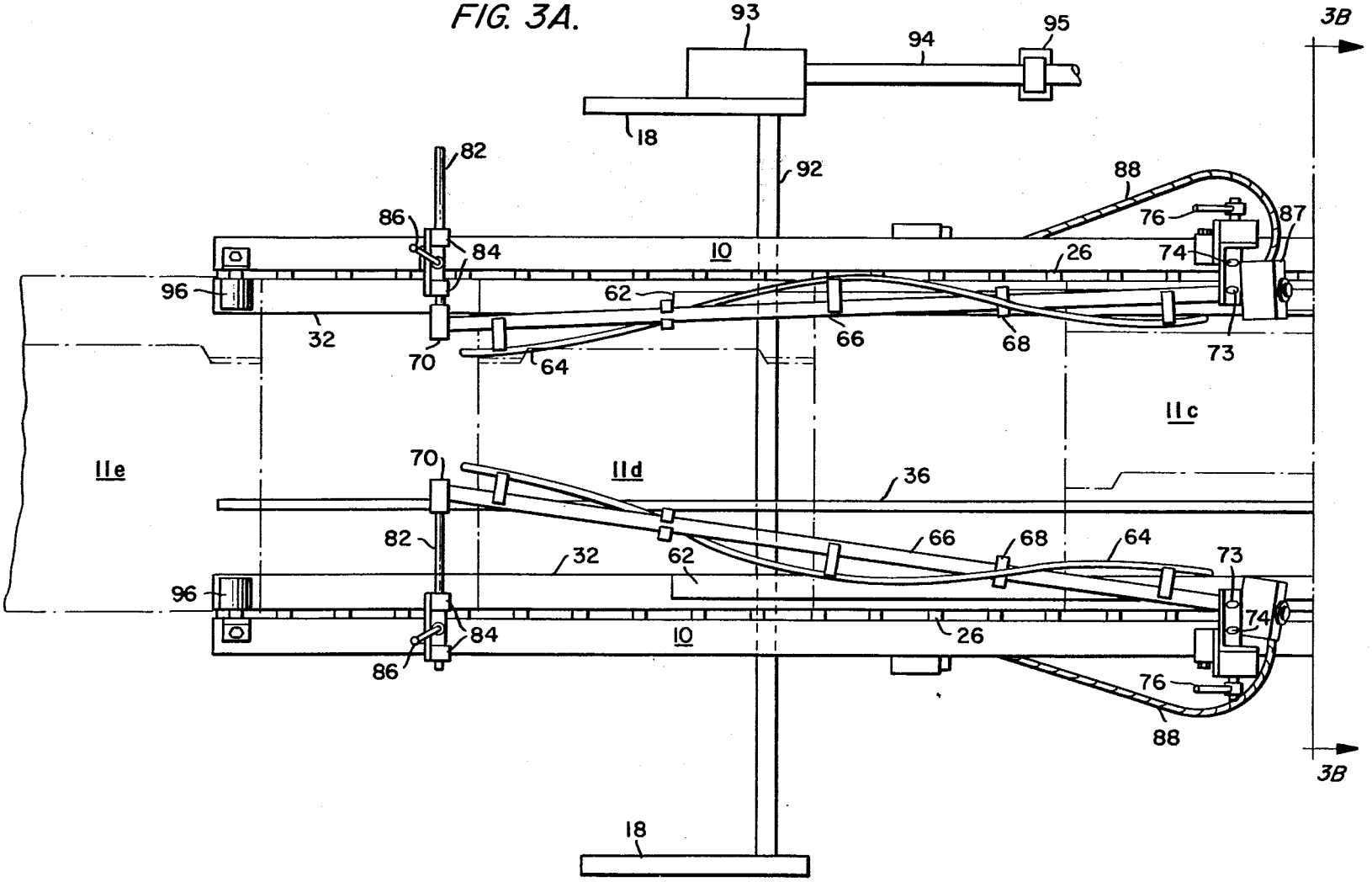
FIG. 3 is a plan view of the whole apparatus partly depicted in FIG. 1 and also depicts the folding operation.
FIG. 3C depicts the relationship of FIGS. 3A and 3B.
Figures 3B, 3C:
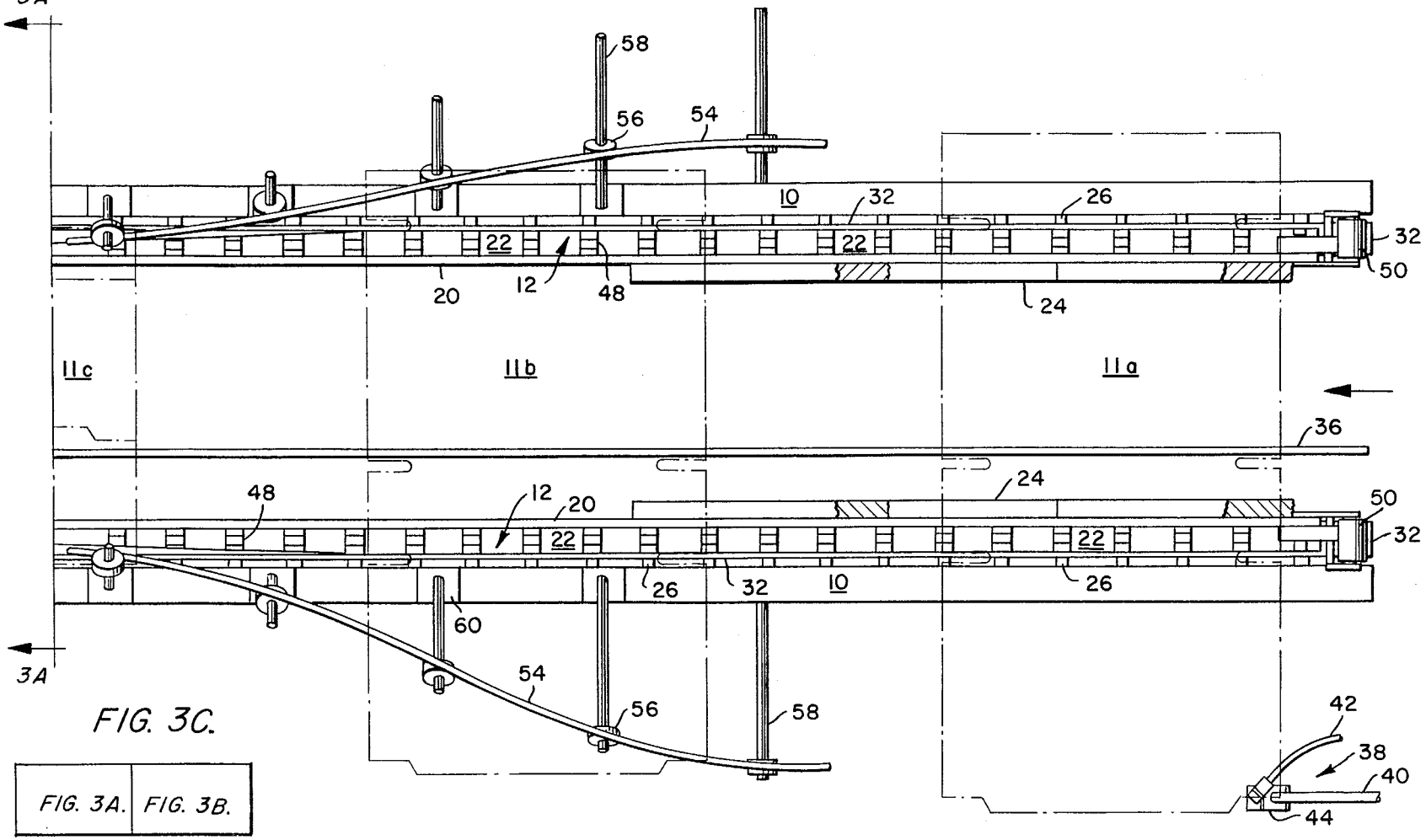

We turn now to the upstream portion of the apparatus where the initial portion of folding is accomplished utilizing stationary rail means. This is depicted in FIGS. 2 and 3B.

Acting in concert with conveyor belts 32 in this portion of the apparatus are upper roller means 48. Each roller means 48 is housed in one of the aforedescribed milled out portions of the elements 22 and extends in the cross machine direction to overlie one of the belts 32 and is positioned to press a blank passing thereunder against the belt 32 below to ensure good gripping contact of a blank by the belt. Each roller means 48 is rotatably supported on a bearing (not shown) which is fixed to a leg 20 of a rail 12.

Also acting in concert with each belt 32 in the upstream portion of the apparatus is an inlet roller 50 which is pivotably supported from a leg 20 of a rail 12 and which is associated with a spring member 52.

The stationary rail means of the upstream portion of the apparatus consists of a stationary blank contacting member 54 on each side of the apparatus. Each element 54 is of material which is somewhat flexible and has a low coefficient of friction surface (e.g. nylon). Each element 54 extends generally in the feed direction and proceeds inwardly and upwardly, reaches a maximum height, then proceeds inwardly and somewhat downwardly before terminating just prior to the portion of the machine where the elongated helical folding means is positioned. Each element 54 is configured and positioned to initially operate on a blank with first and second adjacent panels in the same plane and to fold the first panel causing it to swing through an angle defining the initial portion of folding. In general, an element 54 should cause a swing ranging from about 90 degrees to about 135 degrees, preferably from about 100 degrees to about 110 degrees, thereby providing a blank on which folding is to be completed in the downstream portion of the apparatus by elongated helical folding means having an angle between first and second adjacent panels (entrance angle) ranging from about 45 degrees to about 90 degrees, preferably from about 70 degrees to about 80 degrees.

The members 54 are adjustably mounted by means of swivel joints 56 on rods 58. Each joint 56 is adapted to be moved axially of its associated rod 58 by the operator. By such movement of one or more joints 56, the configuration and/or position of a member 54 is readily changeable.

Each of the rods 58 is mounted on a plate 60 which is fixed to the adjacent lower side rail 10.

We turn now to the downstream portion of the apparatus where folding is completed by elongated helical folding means. This is depicted in FIGS. 1, 2 and 3A.

Acting in concert with the conveyor belts 32 in this portion of the apparatus are elongated spear members 62. These are mounted on each side of the apparatus from the underside of a forward portion of the upper side rail 12 on that side. Each spear member 62 is positioned to overlie one of the belts 32. The spear members 62 terminate sufficiently prior to where folding is completed so as not to be trapped inside the completed fold. The spear members 62 function to press blanks passing thereunder against the adjacent belt 32 to assure good gripping contact between the belt 32 and a blank whereby the blank is conveyed through the portion of the apparatus where the final folding is completed.

The elongated helical folding means consists of means on each side of the apparatus, each comprising a helical blank contacting member 64 supported by spokes 68 on a shaft 66 extending coaxially with the longitudinal axis of the member 64. Each elongated helical folding means is designed to accommodate an entrance angle ranging from about 90 degrees to about 45 degrees, preferably ranging from about 80 degrees to about 70 degrees, and to provide folding of the first panel to overlie the second panel. Each elongated helical folding means is also designed to provide an average folding rate (the average number of degrees the angle included between the first and second panels is reduced per foot of blank travel while in contact with the helical blank contacting member) ranging from about 5 degrees per foot to about 15 degrees per foot, preferably from about 7.5 degrees per foot to about 12.5 degrees per foot, whereby to accomplish smooth folding while minimizing machine length. Once the entrance angle and exit angle are selected, folding rate is designed into the machine by specifying folding distance (distance in direction of travel over which folding is carried out).

Preferably, the helical blank contacting members 64 are each in the form of a cylindrical helix winding around a shaft 66 and having selected radius and pitch. The "radius" is the radius of the enveloping cylinder. The "pitch" is the axial distance (length of axis) needed for the helix to wind around its axis exactly once.

The radius ranges from about 2 inches to about 12 inches and very preferably ranges from about 4 inches to about 5 inches.

Turning now to the pitch, it is very preferably determined from the following formula defining a relationship whereby the contact point between a helical blank contacting member and blank is maintained at approximately the same spot on the blank all during folding:

$$\frac{1}{P} = \left(\frac{\omega}{S} - F\right) \cos\theta$$

In the above formula P is the pitch, $\omega$ is the speed of helix rotation (revolutions per unit time), S is the conveying speed (units of length per unit of time), $\omega/S$ is fixed by the fixed operating ratio discussed in more detail below, F is the folding rate (in revolutions per unit length of board travel) and is designed into the machine as discussed above and $\theta$ is determined by the formula $$\tan^2\theta = \tan^2\alpha + \tan^2\beta$$

where $\alpha$ is the yaw angle (described below) and $\beta$ is the pitch angle (described below).

Deviation from the pitch provided by the formula set forth above causes deviation from the initial contact point whereby the contact point will move in the direction of board travel or opposite to it a distance equal to the difference between the actual pitch and the pitch according to the above formula for each length of travel equal to the pitch according to the above formula. In mathematical terms:

$$v = \frac{P^1 - P}{P} d$$

where V is the variation from the initial contact point, P is the pitch according to the formula in the above paragraph, $P^1$ is the actual pitch, and d is the distance traveled.

It is preferred that the pitch be adapted for the maintenance or continuous contact between a helical blank contacting means and a blank all during the folding within about 12 inches of the initial contact point between the helical blank contacting means and a blank (assuming a blank sized sufficiently to accommodate this deviation), very preferably within about 4 inches.

In general, machines designed to handle longer spacing between blanks (forward edge to forward edge) would preferably employ helical members with longer pitches, for example, pitches up to 200 inches or more, and machines designed to handle shorter spacing between blanks (forward edge to forward edge) might appropriately employ helical members with shorter pitches, for example, down to 50 inches or even less. For a machine designed to fold blanks spaced 66 inches (forward edge to forward edge) an appropriate pitch can be, for example, within the range of 70 to 90 inches.

The helical blank contacting members 64 are preferably constructed to have a low friction surface (e.g. of nylon).

The shafts 66 are positioned so that the common longitudinal axis of a shaft 66 and its associated blank contacting member 64 extends generally in the direction of travel and is parallel to the plane of folding. The back (upstream) end of a shaft 66 is positioned to accommodate the entrance angle of a blank. The forward (downstream) end of a shaft 66 is positioned to provide the exit angle.

The shaft 66 are preferably positioned so that the common longitudinal axis of a shaft 66 and its associated blank contacting member 64 is inclined inwardly and downwardly so as to have a member 64 contact the first panel at a distance from the intervening crease ranging from about 1 inch to about 24 inches, more preferably from about 2 inches to about 14 inches, and most preferably so that this distance is maintained approximately constant (with less than 4 inches of deviation) as the panel is folded.

The angle of inward inclination, that is, the angle of inclination to the vertical plane in the direction of feed or yaw angle, should preferably lie in the range from about 0.5 degrees to about 15 degrees and very preferably in the range from about 1.5 degrees to about 9.5 degrees. The angle of downward inclination, that is, the angle of inclination to the plane of feed or pitch angle, should preferably lie in the range from 0.5 degrees to about 15 degrees, and very preferably in the range from about 0.5 degrees to about 6.5 degrees.

A shaft 66 can be positioned so that its associated blank contacting member 64 initially contacts the first panel at a given distance from the intervening crease with this distance decreasing as the blank proceeds toward the exit. In such case the angle of inward inclination can be near zero degrees or even slightly negative (outward), e.g. up to 2 degrees negative. A shaft 66 can be positioned so that its associated blank contacting member 64 initially contacts the first panel at a given distance from the intervening crease with this distance increasing as the blank proceeds toward the exit. In such case the angle of downward inclination can be near zero or even slightly negative (upward), e.g., up to 2 degrees negative. For the apparatus depicted in FIGS. 2 and 3, one of the yaw or pitch angles has to be at least about 0.5 degrees.

Each shaft 66 is rotatably supported at its back end on a bearing (not depicted) carried in a shaft support carriage (not depicted) and at its forward end on a bearing 70 and is rotatable to rotate its associated helical blank contacting member 64 about their common longitudinal axis.

Each shaft support carriage (not depicted) is movable in a slot (not shown) in the inwardly extending leg of an angle bracket 72 by means including a slide shaft 73 and a screw shaft 74 operated by ratchet means 76. Each angle bracket 72 is mounted on an attached bracket 80 (FIG. 1) which is bolted to a lower side rail 10. By operation of a ratchet means 76, the back end of the associated shaft 66 is movable along a path parallel to the plane of the panel to be contacted by the folding means as a blank enters the helical folder portion of the machine (i.e. parallel to the plane of the entrance angle of the fold).

Each bearing 70 is supported by an arm 82 which is mounted for slidable movement in the cross machine direction in supports 84 and is readily fixed in position or freed to be moved by operation of a set screw means not depicted) by a locking handle 86. By loosening a locking handle 86 and moving an arm 82 and its associated bearing 70, the forward end of the associated shaft 66 is movable in the plane of the exit angle (in this case, horizontally).

Thus, each end of each shaft 66 is independently movable whereby the position of each end is independently adjustable in the plane of folding. Such adjustment is carried out to vary the distance of the contact point from the folding crease to accommodate different width panels and/or to provide increased folding rate on one side at some section of the machine (the average folding rate remains the same) to provide proper positioning of the glue tab.

Each shaft 66 is driven from a right angle gear box 87 which receives its input from a flexible drive shaft 88 driven by a gear box 89 (FIG. 2). Each gear box 89 is driven via a pulley by a belt 90 which is driven by a pulley 91.

The pulleys 91 and 34 are all driven by output shaft 92 which is rotatably supported in plates 18. Output shaft 92 is driven via gear box 93 by input shaft 94. Input shaft 94 is supported in bearing 95 and is driven by a motor used to drive the entire series of machines. Thus the speed of shaft 94 (and the entire sequence of machines) is controlled by controlling said motor whereby the entire series of machines is operated synchronously.

The combination of output shaft 92, pulley 34, pulley 91, belt 90, gear box 89 and its associated pulley, flexible drive shaft 88 and gear box 87 constitutes means to rotate the helical folding means about its longitudinal axis in fixed operating ratio with conveyor speed. Such ratio is fixed so that the number of helix rotations per blank travel over a preselected distance is an integer, preferably one and not usually more than 2. The preselected distance is the spacing used between blanks (forward edge to forward edge) as they travel through the machine. This spacing is the same for all the machines in a series of machines and is usually the circumference of a printing cylinder in a printing unit. Thus, rotation of members 64 and conveyor speed is synchronized so that members 64 rotate in time with a blank being transported so that each time a blank enters, the members 64 are in the same phase of rotation to contact each blank the same way.

Take off rollers 96 are mounted at the exit of the machine on the top of each side rail 10.

We turn now to the operation of the apparatus described above.

Figure 4:
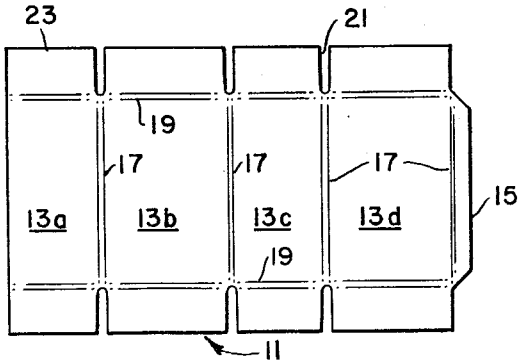
FIG. 4 is a plan view of a blank of the type depicted in FIGS. 1–3 prior to being folded.

The feed consists of blanks 11 as depicted in FIG. 4. Each blank 11 includes four side by side panels 13 and a glue tab 15 separated from each other by longitudinal creases 17. Each panel includes transverse corrugator score lines 19 which with slots 21 define flaps 23.

In the folding operation, outboard panel **13*a* is folded with respect to inboard panel 13*b* along the intervening crease 17 and outboard panel 13*d* (and associated glue tab 15) is folded with respect to inboard panel 13*c* along the intervening crease 17, In the operation depicted in FIGS. 1–3, glue is applied to the top of a tab 15, then folding action is applied to both panels 13*a* and 13*d* with panel 13*a* being folded to overlie panel 13*b* and with panel 13*d* being folded to overlie panel 13*c* with glue tab 15 overlying panel 13*a*. Instead glue could be applied to the bottom of a tab 15 with folding being completed on panels 13*a* and 13*d* so that panel 13*a* overlies tab 15**.

In FIGS. 1–3, the blanks are denoted by reference numeral 11, plus an associated letter with the same letter indicating the same degree of folding. For purposes of simplification, some of the creases 17 have been omitted in FIGS. 1–3 and the corrugator scrore lines 19 have been omitted in FIGS. 2 and 3.

In the operation of the apparatus of FIGS. 1–3, the feed rate (to the apparatus) is determined by the operation of upstream machines and ordinarily ranges, for example, from 1 to about 400 blanks per minute and preferably ranges from about 20 to about 200 blanks per minute. The spacing beteen blanks (forward edge to forward edge) is designed into the apparatus based on upstream apparatus and is usually the circumference of the printing cylinder of a printing unit. Thus for each particular machine, the spacing (forward edge to forward edge) between successive blank is a constant. The feed rate and spacing between blanks determines conveyor speed which is set by the operator upstream in the series of machines and is provided for conveyor belt 32 via input shaft 94 (FIG. 3A).

At the initiation of operation, the positioning of each of the ends of each shaft 66 is adjusted, if necessary, so that the contact point between the helical members 64 and the blanks is always at interior portion of the outboard panels and so that the outboard panels are folded flush in the appropriate order. This is carried out at the upstream end by the turning of ratchet handle 76 whereby the length of a screw shaft 74 is adjusted whereby the associated shaft support carriage (not shown) is movable in the slot in an angle bracket 72 whereby the upstream end of each shaft 66 is appropriately positioned in accordance with the width of the outboard panels. Adjustment is carried out at the downstream end by loosening locking handles 86 and sliding rods 82 in members 84 to move bearings 70.

In the operation described below, apparatus is utilized having the following characteristics: The spacing between blanks (forward edge to forward edge) designed into the machine is 66 inches. Each stationary rail means 54 is positioned and configured to receive blanks not yet subjected to folding and to cause folding of the outboard panels to cause them to swing 105 degrees and provide on each side an entrance angle into the upstream (rotating helical folder) portion of the apparatus of 75 degrees.

The rotating helical folder portion of the machine is designed to provide an average folding rate of 10 degrees per foot of travel for each of the panels folded. Each helical blank contacting member 64 is in the form of a cylindrical helix with a radius of 4.5 inches and a pitch of 78.4 inches. The elongated helical folding means on the left (looking in the direction of travel) is positioned so that the longitudinal axis of its blank contacting means is inwardly inclined at an angle of approximately 7 degrees and downwardly inclined at an angle of approximately 5 degrees. The elongated helical folding means on the right (looking in the direction of feed) is positioned so that the longitudinal axis of its blank contacting means is inwardly inclined at an angle of approximately 6 degrees and downwardly inclined at an angle of approximately 2 degrees. The fixed operating ratio is such as to provide one revolution of a shaft means 66 for each 66 inches of blank travel.

The operation is described below in relation to blanks 40 inches in the direction of board travel, fed at the rate of 120 blanks per minute spaced apart (forward edge to forward edge) 66 inches utilizing a conveyor speed of 660 feet per minute. In the operation, the contact point between a helical blank contacting member 64 and an outboard panel is always within 4 inches of the initial contact point. In the operation, folding is carried out smoothly and without impacting forces being applied and with no folding along a corrugator score and substantially no "fish tailing".

Turning now to the operation in more detail, the blanks 11 are fed one by one in timed sequence into the upstream end of the apparatus as depicted in FIGS. 2 and 3B. The blanks are fed over bar 36 and under initial rollers 50 and between upper rollers 48 and conveyor belts 32 and atop curved bar 46 with the glue tab adjacent bar 46. Each blank is supported on bar 36, belts 32 and bar 46. The rollers 48 push the blank being fed into belts 32 whereby the belts 32 engage and grip a blank and start it through the machine. As a blank enters the apparatus, glue is applied to glue tab 15 by applicator 38. Entering blanks 11*a*, after glue application and prior to folding are depicted in FIGS. 2 and 3B.

As belts 32 convey a blank through the apparatus, the inboard panels are supported in the plane of travel by belts 32 and bar 36 and the outboard panels of the blank are contacted by stationary rail elements 54 whereby each outboard panel is caused to swing relative to an adjacent inboard panel along the crease between the panels. A blank being subjected to folding by members 54 is depicted as 11*b*. The elements 54 each cause a swing of 105 degrees and provide entrance angles into the upstream (elongated helical folder) portion of the apparatus of 75 degrees.

As a blank 11 is being converted through the portion of the apparatus with the stationary rail folding elements, its inboard panels pass under spear members 62 which push the blank into belts 32 whereby it is engated and ripped by belts 32 and moved into and through the helical folding means portion of the apparatus. The blank is continued to be supported by bar 36 and belts 32.

As a blank 11 continues through the apparatus it is initially engaged without impact at an interior portion of each outboard panel by a rotating helical member 64 (the back end of each rotating helical member, having been adjusted, if necessary, to provide the appropriate initial contact point). The blank entering for initial contact is denoted 11*c*.

After such initial contact, the conveying of the blank is continued through the apparatus by belts 32 and helical members 64 rotate and continuously contact only interior portion of outboard panel whereby folding is completed so that first the right (looking in the direction of travel) outboard panel is folded to overlie the adjacent inboard panel and then the left (looking in the direction of travel) outboard panel is folded to overlie the adjacent inboard panel and the glue flap is caused to caused to overlie the right outboard panel whereby it is glued thereto forming a closed flat tube. The spear members 62 terminate prior to the end of folding so as not to interfere with completion of folding. The flattened tube is conveved by belts 32 under take-off rollers 96 which maintain the tube in flattened form whereupon each flattened tube enters downstream apparatus, e.g., a counter/ejector. A blank being subjected to folding by rotating helical members 64 is denoted 11*d*, and the blank on which folding has been completed and which is leaving under take-off rollers 96 is denoted by reference number 11*e*. The folding by the elongated helical folding elements 54 is carried out smoothly (i.e., at a rate of 10 degrees per foot of blank travel) over a distance equal to 2.3 times the blank length.

One specific form of the invention is described above in conjunction with FIGS. 1–3. However, the invention herein embraces a plurality of embodiments and is not limited to that depicted in FIGS. 1–3. Description below provides basis for the broader invention.

Apparatus herein with a single elongated helical folding means is useful to provide folding in any portion of the 180 degrees of fold with the amount of folding limited to approximately 105 degrees. The folding means is positioned according to the selected entrance angle and to provide the selected exit angle. For folding in the first half of the 180 degree fold, the helical blank contacting means can desirably be positioned so that its longitudinal axis extends upwardly and inwardly. For exit angles greater than 0 degrees, flush folding can be accomplished, if desired, by downstream means.

Apparatus within the scope of the invention can include a plurality (for example, two or three or more) of elongated helical folding means positioned in succession and used in series, for example, to accomplish more than 105 degrees of folding, for example 180 degrees of folding. Such apparatus preferably is designed so each of the succession of elongated helical folding means provides an equal amount of folding. Each of the plurality of elongated helical folding means comprises (i) helical blank contacting means having a longitudinal axis extending generally in the direction of travel and (ii) shaft means which supports said helical blank contacting means, which extends coaxially with said longitudinal axis, which is rotatable to rotate said helical blank contacting means about said longitudinal axis, and which has ends positioned to accommodate the entrance angle and provide selected exit angle. The apparatus includes means to rotate each shaft means to rotate the associated helical blank contacting means about its longitudinal axis in fixed operating ratio with conveyor speed.

Figure 5:
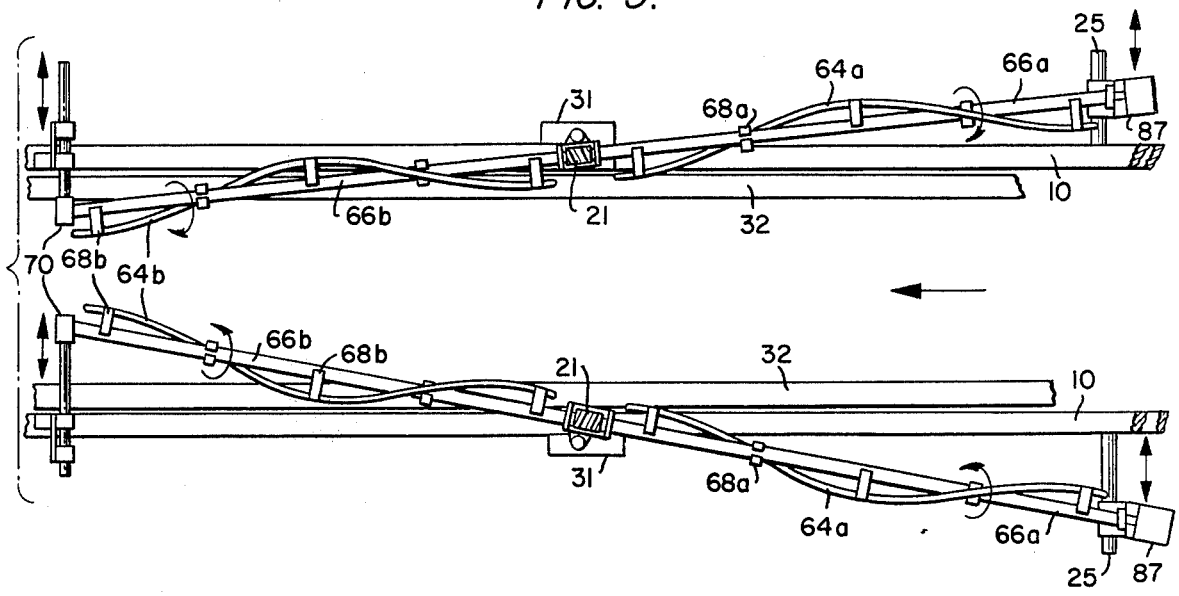
FIG. 5 is a simplified plan view of apparatus within the scope of the invention which includes a plurality of elongated helical folding means whereby to accomplish 180 degrees of folding.
Figure 6:
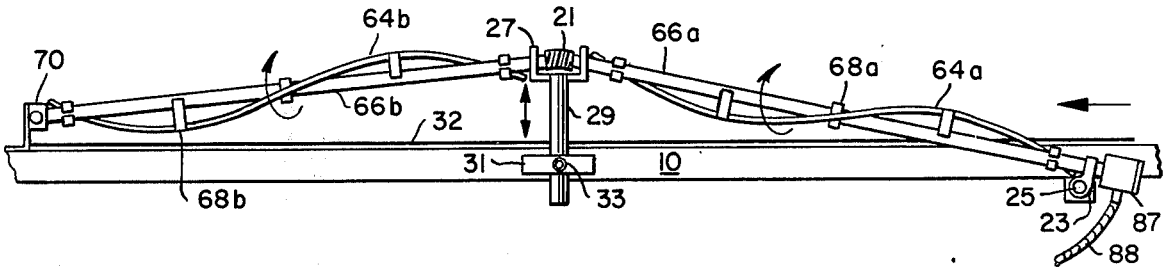
FIG. 6 is a side view of the apparatus of FIG. 5.

Preferred apparatus of the type described in the above paragraph is depicted schematically in FIGS. 5 and 6. The apparatus of FIGS. 5 and 6 includes side rails 10 and conveyor belts 32 trained on rollers (not shown) which are associated with the side rails 10 by means not shown. The belts 32 are driven by means not shown. Spear members (not shown) are associated with the belts. Each side of the apparatus includes an upstream elongated helical folding means and a downstream elongated helical folding means. Each upstream elongated helical folding means includes a helical blank contacting means 64*a* supported by spokes 68*a* on a rotatable shaft 66*a* coaxial with the longitudinal axis of the means 64*a* and having a back (upstream) end positioned to accommodate an entrance angle of 180 degrees and a forward (downstream) end positioned to provide an exit angle of 90 degrees. A shaft 66*a* is inclined upwardly (e.g. at an angle of 10 degrees in relation to the plane of travel) and inwardly (e.g. at an angle of 10 degrees in relation to a vertical plane in the direction of travel). Each downstream elongated helical folding means includes a helical blank contacting means 64*b* supported by spokes 68*b* on a rotatable shaft 66*b* coaxial with the longitudinal axis of the means 64*b* and having a back (upstream) end positioned to accommodate an entrance angle of 90 degrees and a forward (downstream) end positioned to provide an exit angle of 0 degrees. A shaft 66*a* is inclined downwardly (e.g. at an angle of 10 degrees in relation to the plane of travel) and inwardly (e.g. at an angle of 10 degrees in relation to a vertical plane in the direction of travel). The forward (downstream) end of a shaft 66*a* is joined to the back (upstream) end of a shaft 66*b* by a flexible coupling 21, and a single flexible drive shaft 88 is connected via a gear box 87 with the upstream end of the shaft 66*a* whereby successive shafts 66*a* and 66*b* are driven. The upstream end of a shaft 66*a* is supported by a bearing 23. Each bearing 23 is movable horizontally on a rod 25 whereby to adjust the position of said upstream end. The downstream end of a shaft 66*b* is supported on a bearing 70 which is movable horizontally by means the same as that described in relation to the bearings 70 of FIGS. 1–3. The downstream end of a shaft 66*a* and the adjacent upstream end of a shaft 66*b* are supported in a bearing 27 which is mounted on a rod 29 which is slideable in a member 31 which is fixed to a rail 10 and which contains a lock screw 33 whereby said ends are adjustable in a vertical direction.

In the operation of the folder of FIGS. 5 and 6, a blank in unfolded condition enters the apparatus and is operated on by the upstream folders to cause each outboard panel to swing 90 degrees leaving with an exit angle of 90 degrees. The blank then is operated on by the downstream folders whereby folding is completed so that the outboard panels overlie the adjacent inboard panels.

Figure 7:
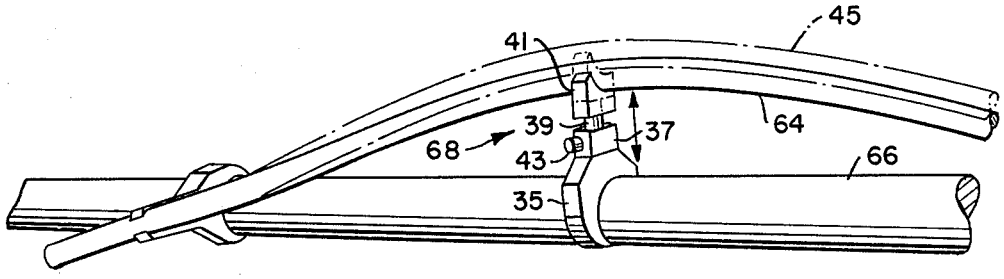
FIG. 7 depicts means for changing the shape of a helical blank contacting member.

In another embodiment of this invention, the elongated helical folding means comprises a helical member supported on a rotatable shaft extending coaxially with the longitudinal axis of the helical member by spokes which are independently adjustable radially of said shaft to move at least a portion of the helical member relative to the shaft. The helical member is constructed of material sufficiently flexible to allow such movement (e.g. nylon). Adjustment of the length of the spokes can change the configuration of the helical member so that, for example, it is partly or totally in the form of a conical helix thereby allowing the helical member to contact a blank farther from the forward edge on long sheets and providing further means to adjust the folding rate. As depicted in FIG. 7, preferred means for this embodiment includes spokes 68 comprising a collar 35 having a boss 37 and an adjustable seat means including a U-shaped forward position 41 mounted in a slide rod 39. The collar 35 holds the spoke to the shaft 66 and the U-shaped forward position 41 supports the helical member 64. A rod 39 is slidable in a bore in a boss 37 and is locked in place or freed for adjustable movement by a lock screw 43. The helical member 64 is depicted in adjusted position by dotted lines 45.

In another desirable embodiment of this invention, the elongated helical folding means includes a plurality of coaxial helical members each in the form of a cylindrical helix. Each member has identical pitch and a different radius and is adapted to contact a panel in a plurality of interior portions whereby a better distribution of folding force on the panel contacted by the elongated helical folding means is accomplished. This is especially useful for long blanks.

In the depicted embodiments, the folders of this invention are shown as "up folders", that is, where the second panel is supported from below. This invention also embraces "down folders", that is, where support for the second panel is from above. In a preferred "down folder", the conveyor belt is above the rotating helical means and spear means (shorter than that depicted in FIGS. 1–3 relative to the helical folding means) is used to initially hold each blank against the belt and the conveyor includes a vacuum belt section at the exit end of the apparatus to hold the blank after the termination of the spear member.

The invention may be embodied in still other specific forms without departing from the essential characteristics thereof. In view of the variations that are readily understood to come within the limits of the invention, such limits are defined by the scope of the claims.

What is claimed is:

1. Apparatus for folding paperboard blanks fed one by one in timed sequence into said apparatus, each of said blanks comprising a first panel and a second panel separated by a crease, said folding comprising folding said first panel with respect to said second panel along said crease from an initial angular relationship between said panels denoted an entrance angle to a resulting angular relationship between said panels denoted an exit angle, said apparatus comprising (a) conveyor means adapted to transport said blanks one by one in a direction of travel with said second panel being moved along a plane of travel;

(b) elongated helical folding means comprising (i) helical blank contacting means having a longitudinal axis extending generally in the direction of travel, and (ii) shaft means which supports said helical blank contacting means, which extends coaxially with said longitudinal axis, which is rotatable to rotate said helical blank contacting means about said longitudinal axis, and which has ends positioned to accommodate said entrance angle and provide said exit angle;

(c) means to rotate said shaft means to rotate said helical blank contacting means about said longitudinal axis in fixed operating ratio with conveyor speed; the configuration and positioning of said elongated helical folding means and said fixed operating ratio being adapted to provide initial contact between said helical blank contacting means and said first panel without impact and at only an interior portion of said first panel, and to provide thereafter, as a blank is being transported, continuous contact between said helical blank contacting means and only interior portion of said first panel, to fold said first panel smoothly toward said second panel.

2. Apparatus as recited in claim 1 which is for operation on blanks with an entrance angle ranging from about 90 degrees to about 45 degrees at an average folding rate ranging from about 5 degrees per foot of travel to about 15 degrees per foot of travel, in which said helical blank contacting means is in the form of a cylindrical helix having a radius ranging from about 2 inches to about 12 inches and a pitch adapted to maintain continuous contact with a blank within about 12 inches of the initial contact point, and in which said longitudinal axis is inwardly inclined at an angle ranging from about 0.5 degrees to about 15 degrees and downwardly inclined at an angle ranging from 0.5 degrees to about 15 degrees.

3. Apparatus as recited in claim 2 which is for operation on blanks with an entrance angle ranging from about 80 degrees to about 70 degrees at an average folding rate ranging from about 7.5 degrees per foot of travel to about 12.5 degrees per foot of travel, in which said helical blank contacting means is in the form of a cylindrical helix having a radius ranging from about 4 inches to about 5 inches and a pitch adapted to maintain continuous contact with a blank within about 4 inches of the initial contact point, and in which said longitudinal axis is inwardly inclined at an angle ranging from about 1.5 degrees to about 9.5 degrees and downwardly inclined at an angle ranging from about 0.5 degrees to about 6.5 degrees.

4. Apparatus as recited in claim 3, in which said apparatus includes means for adjusting the position of the ends of the shaft means.

5. Apparatus as recited in claim 4, in which said means for adjusting includes supporting means for each end of said shaft means independently movable to independently move said ends.

6. Apparatus as recited in claim 5, including additionally stationary rail folding means which is adapted to initially operate on a blank with the first and second panels in the same plane and to fold said first panel causing it to swing through an angle ranging from about 90 degrees to about 135 degrees, and in which the elongated helical folding means is adapted to operate on a blank treated by said stationary rail folding means and to fold said first panel against said second panel.

7. Apparatus as recited in claim 1, including a plurality of elongated helical holding means positioned in succession whereby to accomplish 180 degress of folding.

8. Apparatus as recited in claim 1, in which said helical blank contacting means is supported on said shaft means by spokes which are independently adjustable transversely of said shaft means to reposition at least a portion of said helical blank contacting means relative to said shaft means.

* * * * *